United States Patent [19]

Foreman

[11] 4,008,404

[45] Feb. 15, 1977

[54] INTERVAL TIMER

[75] Inventor: Donald S. Foreman, Fridley, Minn.

[73] Assignee: Honeywell Inc., Minneapolis, Minn.

[22] Filed: Dec. 29, 1975

[21] Appl. No.: 644,669

[52] U.S. Cl. ..... 307/149; 340/41 R
[51] Int. Cl.[2] ..... G08G 1/07
[58] Field of Search ..... 307/112, 115, 149; 340/41 R, 40, 37, 36, 35

[56] References Cited

UNITED STATES PATENTS

| | | | |
|---|---|---|---|
| 3,434,115 | 3/1969 | Chomicki | 340/41 R |
| 3,763,466 | 10/1973 | Howard et al. | 340/41 R |

*Primary Examiner*—Herman J. Hohauser
*Attorney, Agent, or Firm*—David R. Fairbairn

[57] ABSTRACT

An interval timer for use in traffic control, industrial process control, or other interval timing applications includes a gated pulse generator.

13 Claims, 1 Drawing Figure

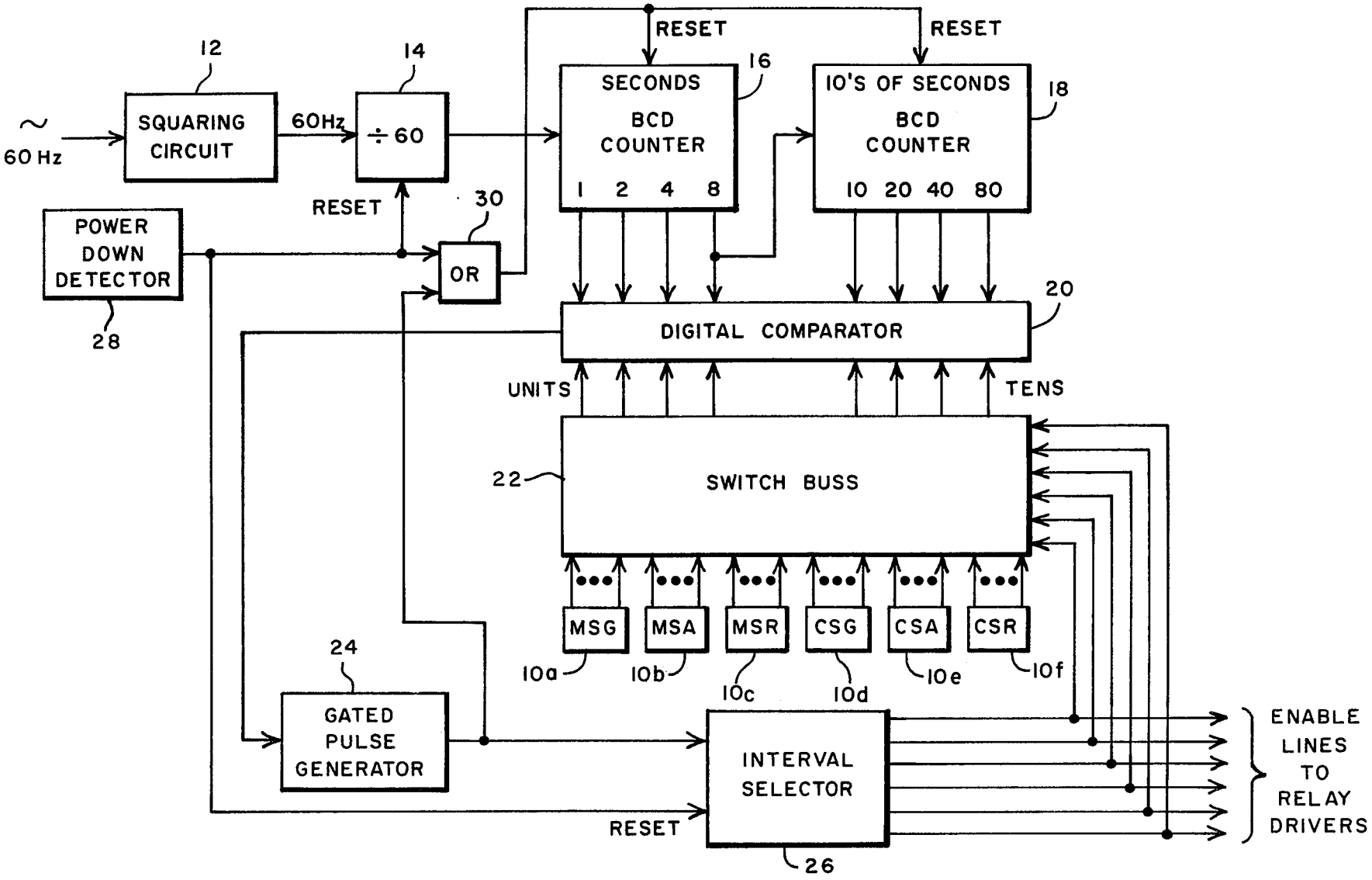
60 Hz
SQUARING CIRCUIT
12
60Hz
÷ 60
14
RESET
POWER DOWN DETECTOR
28
OR
30
RESET
SECONDS BCD COUNTER
1 2 4 8
16
RESET
10'S OF SECONDS BCD COUNTER
10 20 40 80
18
DIGITAL COMPARATOR
20
UNITS
TENS
SWITCH BUSS
22
MSG
MSA
MSR
CSG
CSA
CSR
10a
10b
10c
10d
10e
10f
GATED PULSE GENERATOR
24
INTERVAL SELECTOR
26
RESET
ENABLE LINES TO RELAY DRIVERS

INTERVAL TIMER

REFERENCE TO CO-PENDING APPLICATION

Reference is made to a co-pending patent application by Donald S. Foreman entitled "Gated Pulse Generator", which was filed on even date herewith and which is assigned to the same assignee as this application.

BACKGROUND OF THE INVENTION

The present invention relates to an interval timing system that provides load control during timed intervals. In particular, the present invention is an interval timer which may be used for a variety of applications including industrial process control and traffic control.

In recent years, considerable effort has been expended in the development of solid state electronic interval timers, particularly to replace the prior art electro-mechanical traffic controllers. The solid state interval timers have the advantages of lower cost, smaller size, lower power consumption, and greater flexibility of functions performed than the prior art devices.

SUMMARY OF THE INVENTION

The present invention includes output signal generating means, interval duration determining means, and gated pulse generator means. The output signal generating means generates a set of output signals associated with each interval of a sequence of timed intervals. The interval duration determining means derives the timed intervals by counting, and changes from a first to a second state when a preset value is reached. The time required to reach the preset value depends upon the particular interval. The gated pulse generator means produces a control pulse which causes the output signal generating means and the interval duration determining means to advance to the next interval. The control pulse is produced only when the interval duration determining means remains in the second state for greater than a predetermined time.

BRIEF DESCRIPTION OF THE DRAWING

The FIGURE is a system block diagram of a traffic controller in accordance with the present invention.

DETAILED DESCRIPTION OF THE PREFERRED EMBODIMENTS

The FIGURE shows a system block diagram of a traffic controller, which is one form of the interval timer of the present invention. The traffic controller shown in the FIGURE is a portable two-phase backup intersection controller which may be used in emergency situations such as the failure or malfunctioning of the normal intersection controller. It is small, lightweight, rugged, low cost, and capable of simple and rapid installation in the field.

The traffic controller includes an interval duration determining means formed by thumbwheel switches 10*a* – 10*f*, squaring circuit 12, frequency divider 14, counters 16 and 18, a digital comparator 20, and switch buss 22. The traffic controller also includes gated pulse generator 24, interval selector 26, power down detector 28, and logic "OR" circuit 30.

The traffic controller of the FIGURE applies power to each of the lights in an intersection in the proper sequence according to a preset schedule. This schedule is set by the operator with the use of thumbwheel switches 10*a* – 10*f*. The time duration for each of six intervals is determined by the number selected for each of the thumbwheel switches.

Interval selector 26 is an output signal generating means which has six output lines, one for each of the six intervals. These output lines are connected to relay drivers (not shown) which operate the particular lights associated with each of the six intervals. In its preferred form, interval selector 26 is a counter whose count is decoded so that only one of the six lines is selected at any time.

The output of interval selector 26 also controls switch buss 22. Switch buss 22 selectively connects one of the six sets of thumbwheel switches to digital comparator 20.

Counters 16 and 18 count up to the preset number determined by the particular thumbwheel switch which has been selected. The rate of counting is determined by the clock signal produced by squaring circuit 12 and frequency divider 14. In the FIGURE, a 60 Hz signal is squared by squaring circuit 16 and divided by 60 by frequency divider 14 to produce a 1 Hz signal. This 1 Hz signal, therefore, advances counters 16 and 18 at a rate of one count per second.

Counters 16 and 18 count seconds until the number of seconds elapsed agrees with the number present on the selected thumbwheel switch. At this time, the output of digital comparator 20 changes from a first state to a second state. For the purposes of this discussion, the first state will be designated a logic 1 and the second state will be designated a logic 0.

Gated pulse generator 24, which is preferably of the type described in the previously mentioned co-pending patent application entitled Gated Pulse Generator, receives the output of digital comparator 20. Gated pulse generator 24 preferably meets several requirements. First, it generates a control pulse if the input signal is 0 for greater than a certain minimum time period (usually about 2 microseconds). The gated pulse generator must continue to generate control pulses if the input signal stays 0 for a longer period. This will occur if the next interval is skipped and the thumbwheel switch is, therefore, set at zero. In other words, gated pulse generator 24 must emit a control pulse for every period in which the input signal is continuously 0 for greater than 2 microseconds.

Second, if the input signal changes from 0 to 1 before the 2 microsecond period has elapsed, no control pulse must be produced. The pulse generation cycle is terminated without a control pulse being produced. Gated pulse generator 24, therefore, has a minimum gating interval discrimination. This eliminates noise transients which may be present in the input signal.

Third, once a control pulse is started, it must continue for its full duration no matter what happens to the input signal. In other words, gated pulse generator 24 is insensitive to the state of the input signal once the control pulse begins.

The control pulse from gated pulse generator 24 advances interval selector 26 to the next interval in the sequence. The output of interval selector 26, enables the various relay drivers associated with the next interval and also advances switch buss 22 to the thumbwheel switches associated with the next interval.

The control pulse from gated pulse generator 24 also resets counters 16 and 18 to zero. Counters 16 and 18 will then again begin counting up until the count equals the number stored in the selected thumbwheel switch.

The power down detector 28 prevents the traffic controller from operating if insufficient power is present to properly operate the controller. When the power down detector 28 detects low power, it applies a reset signal to frequency divider 14, to interval selector 26, and through OR gate 30 to counters 16 and 18. This reset signal holds the counters in a zero state until power is restored.

The reset signal from power down detector 28 also causes interval selector 26 to return to a predetermined interval of the sequence of intervals. The power down detector 28, therefore, ensures that when power is restored, the controller always starts at the same interval, thus providing a predictable starting point. It also prevents erratic operation of the system by ensuring that it is held in a known state until sufficient voltage is available to operate the logic circuits.

In one successful embodiment of the system shown in the FIGURE, the sequence of an interval included two phases of three intervals each. Table 1 shows this phase sequence.

TABLE 1

PHASE SEQUENCE

| | Interval | Lights On Main St. | Lights On Cross St. | Control Switch | (Thumbwheel) |
|---|---|---|---|---|---|
| Phase I Main Street | 1 | Green | Red | Main Street-Green | 10a |
| | 2 (Startup) | Amber | Red | Main Street-Amber | 10b |
| | 3 | Red | Red | Main Street-Red | 10c |
| Phase II Cross Street | 4 | Red | Green | Cross Street-Green | 10d |
| | 5 | Red | Amber | Cross Street-Amber | 10e |
| | 6 | Red | Red | Cross Street-Red | 10f |

In this embodiment, "Implied Red" logic is incorporated in the controller. This means that any time one street is either green or amber, the other street must be red. The total red time on either street, therefore, is the sum of green and amber times on the other street, and the times when both streets are red. Thumbwheel switch 10*c*, which is labeled "Main Street-Red", sets the duration of the period when both lights are red (all red clearance) before the cross street turns green. Similarly, thumbwheel switch 10*f* labeled "Cross Street-Red" sets the duration of red on the cross street (all red clearance) before the main street turns green.

If the operator has set one of the thumbwheel switches to zero, that interval is skipped in the sequence. Skipping the interval is ordinarily used only to eliminate one or both of the all red clearance interval in which signals on both streets are red. Because the interval times are independent of each other, the total cycle time is the sum of all of the individual interval times.

In the embodiment described in Table 1, interval 2 is the startup interval. Whenever power is restored to the controller, power down detector 28 causes interval selector 26 to start the phase sequence with interval 2. As shown in Table 1, this interval requires amber light on the main street and a red light on the cross street.

Many modifications and variations to the system shown in the FIGURE may be made. For example, other interval duration determining means may be used in place of the clock, counters, digital comparator, switch buss, and thumbwheel switches shown in the FIGURE. What is required is that the system include interval duration determining means which derives the timed intervals by counting to a preset value. The time required to reach the preset value will depend upon the particular interval. It is possible, therefore, to start the counters from a number other than zero or to count down rather than up. In addition, other timing means for providing a number indicative of the desired time duration of each interval may be used rather than thumbwheel switches and a switch buss.

Although the present invention has been described in terms of a preferred embodiment which is a traffic intersection controller, it will be clear that the present invention may be used for other applications as well. For example, the interval timer of the present invention may be used for industrial process control in which a sequence of timed intervals are required. Although the preferred embodiment shown has six intervals, the number of intervals is a matter of choice, and depends upon the particular application of the interval timer.

The embodiments of the invention in which an exclusive property or right is claimed are defined as follows:

1. A traffic controller for providing a set of traffic control output signals for each interval of a sequence of timed intervals, the traffic controller comprising:

interval select means for selecting a particular interval, the selected interval having an associated set of traffic control output signals;

clock means for producing clock signals;

counter means for counting in response to the clock signals;

interval timing means for providing for each selected interval, a number indicative of a desired time duration of the selected interval;

comparator means for switching from a first to a second state when the count of the counter equals the number provided by the interval timing means; and gated pulse generator means for generating a control pulse to cause the interval select means to select another one of the intervals, the gated pulse generator means providing the control pulse when the comparator means remains in the second state for greater than a predetermined time.

2. The traffic controller of claim 1 wherein the control pulse also resets the counter means.

3. The traffic controller of claim 1 wherein the interval timing means comprises:

storing means for storing a number of each of the selected intervals; and switching means for selectively applying one of the numbers to the comparator means.

4. The traffic controller of claim 3 wherein the storing means comprises a plurality of thumb-wheel switches.

5. The traffic controller of claim 4 wherein the switching means comprises a switching buss for selectively connecting the thumb-wheel switches to the comparator means.

6. The traffic controller of claim 1 wherein the interval select means sequentially selects intervals and wherein the control pulse advances the interval select means to the next interval in a sequence.

7. The traffic controller of claim 1 wherein the gated pulse generator means continues to produce control pulses at a predetermined rate so long as the comparator means remains continuously in the second state.

8. The traffic controller of claim 7 wherein a change from the second state to the first state of the comparator means does not affect production of the control pulse if production of the control pulse has begun prior to the change from the second state to the first state.

9. The traffic controller of claim 1 and further comprising:

power down detector means for providing a reset signal to the interval select means and the counter means when power to the traffic controller is reduced below a minimum operating level, whereby the traffic controller commences operation with a predetermined interval of the sequence of timed intervals upon restoration of power.

10. Apparatus comprising:

means for generating a set of output signals associated with each interval of a sequence of timed intervals;

means for producing clock pulses;

means for storing a number representative of the interval time duration for each interval;

means for counting to a preset value in response to the clock pulses, the number of counts required to reach the preset value for each interval being determined by the number representative of the interval time duration for that interval;

means for changing from a first state to a second state when the preset value is reached; and means for generating a control pulse whenever the means for changing from a first to a second state is continuously in the second state for greater than a minimum time period, the control pulse causing the means for generating the set of output signals to switch to the set of output signals associated with the next interval and causing the means for counting to begin counting to a preset value, the time required to reach the preset value being determined by the number representative of the interval time duration of the next interval.

11. Apparatus comprising:

output signal generating means for generating a set of output signals associated with each interval of a sequence of timed intervals;

interval duration determining means for deriving the timed intervals by counting to a preset value, the time required to reach a preset value depending upon the particular interval of the sequence of timed intervals; the interval duration determining means changing from a first to a second state when the preset value is reached; and gated pulse generator means for producing a control pulse which causes the output signal generating means and the interval duration determining means to advance to the next interval, the gated pulse generator means being operable only when the interval duration determining means remains in the second state for greater than a predetermined time.

12. The apparatus of claim 11 and further comprising:

power down detector means for providing a reset signal to the output signal generating means and the interval duration determining means when power to the apparatus is reduced below a minimum operating level, whereby the apparatus commences operation with a predetermined interval of the sequence of timed intervals upon restoration of power.

13. The apparatus of claim 11 wherein the interval duration determining means comprises:

clock means for producing clock signals;

counter means for counting in response to the clock signals;

interval timing means for providing for each interval a number indicative of the desired time duration of the interval; and comparator means for switching from a first to a second state when the count of the counter equals the number provided by the interval timing means.

* * * * *